US005451469A

United States Patent [19]

Gustafson et al.

[11] Patent Number: 5,451,469

[45] Date of Patent: Sep. 19, 1995

[54] CEMENTED CARBIDE WITH BINDER PHASE ENRICHED SURFACE ZONE

[75] Inventors: Per Gustafson, Huddinge; Leif Akesson, Alvsjo; Ake Ostlund, Taby, all of Sweden

[73] Assignee: Sandvik AB, Sandviken, Sweden

[21] Appl. No.: 159,257

[22] Filed: Nov. 30, 1993

[30] Foreign Application Priority Data

Dec. 18, 1992 [SE] Sweden ..... 9203851

[51] Int. Cl.[6] ..... B22F 7/06

[52] U.S. Cl. ..... 428/548; 428/547; 428/522

[58] Field of Search ..... 419/10, 25, 16, 38, 419/45, 47; 428/547, 548, 552

[56] References Cited

U.S. PATENT DOCUMENTS

| | | | |
|---|---|---|---|
| 4,277,283 | 7/1981 | Tobioka et al. | 75/238 |
| 4,610,931 | 9/1986 | Nemeth et al. | 428/547 |
| 4,830,930 | 5/1989 | Taniguchi et al. | 428/547 |
| 5,106,674 | 4/1992 | Okada et al. | 428/552 |

*Primary Examiner*—Donald P. Walsh

*Assistant Examiner*—John N. Greaves

*Attorney, Agent, or Firm*—Burns, Doane, Swecker & Mathis

[57] ABSTRACT

There is disclosed a new process for binder phase enrichment. The process combines binder phase enrichment by dissolution of cubic phase with the requirements that cause formation of stratified layers, resulting in a unique structure. The new structure is characterized by, in comparison with the ones previously known, deeper stratified layers and less maximum binder phase enrichment. The possibility of combining dissolution of the cubic phase with formation of stratified layers offers new possibilities to optimize the properties of tungsten carbide based cemented carbides for cutting tools.

The new process offers possibilities to combine the two types of gradients. The dissolution of cubic phase moves the zone with maximum amount of stratified binder phase from the surface to a zone close to and below the dissolution front. By controlling the depth of dissolution, the interstitial balance and the cooling rate, a cemented carbide with a unique combination of toughness and plastic deformation resistance can be achieved.

5 Claims, 1 Drawing Sheet

CEMENTED CARBIDE WITH BINDER PHASE ENRICHED SURFACE ZONE

BACKGROUND OF THE INVENTION

The present invention relates to coated cemented carbide inserts with a binder phase enriched surface zone and processes for the making of the same. More particularly, the present invention relates to coated inserts in which the binder phase enriched surface zone has been modified in such a way that a unique combination of toughness behavior and plastic deformation resistance can be achieved.

Coated cemented carbide inserts with binder phase enriched surface zone are today used to a great extent for machining of steel and stainless materials. Through the use of a binder phase enriched surface zone, an extension of the application area for such inserts is obtained.

Methods of producing binder phase enriched surface zones on cemented carbides containing WC, cubic phase and binder phase are known as gradient sintering and have been known for some time, e.g., through U.S. Pat. Nos. 4,277,283, 4,610,931, 4,830,930 and 5,106,674.

U.S. Pat. Nos. 4,277,283 and 4,610,931 disclose methods to accomplish binder phase enrichment by dissolution of the cubic phase close to the insert surfaces. Their methods require that the cubic phase contains some nitrogen, since dissolution of cubic phase at the sintering temperature requires a partial pressure of nitrogen (nitrogen activity) within the body being sintered exceeding the partial pressure of nitrogen in the sintering atmosphere. The nitrogen can be added through the powder and/or the furnace atmosphere at the beginning of the sintering cycle. The dissolution of cubic phase results in small volumes that will be filled with binder phase giving the desired binder phase enrichment. As a result, a surface zone generally about 25 μm thick consisting of essentially WC and binder phase is obtained. Below this zone, a zone with an enrichment of cubic phase and a corresponding depletion in binder phase is obtained. As a consequence, this zone is embrittled and cracks grow more easily. A method of elimination of this latter zone is disclosed in U.S. Ser. No. 08/019,701 (our reference: 024000-927), herein incorporated by reference.

Binder phase enriched surface zones can also be formed by controlled cooling, e.g., according to U.S. Pat. No. 5,106,674, or by controlled decarburization at constant temperature in the solid/liquid region of the binder phase after sintering or in the process of sintering, e.g., according to U.S. Pat. No. 4,830,930. The structure in this kind of binder enriched cemented carbide insert is characterized by an up to 25–35 μm thick surface zone containing stratified layers, 1–3 μm in thickness, of binder phase mainly parallel to the surface. The thickest and most continuous layers are found close to the surface within the first 15 μm. Furthermore, the interior of the insert is characterized by a certain amount of free carbon.

The ability of certain cemented carbides to form a stratified structure has been known for a long time. The degree of binder phase enrichment in the zone and its depth below the surface depend strongly on the interstitial balance and on the cooling rate through the solidification region, after sintering. The interstitial balance, i.e., the ratio between the amount of carbide/nitride-forming elements and the amount of carbon and nitrogen, has to be controlled within a narrow composition range for controlled formation of the stratified layers.

Cemented carbides with a binder phase enrichment formed by dissolution of the cubic phase are normally characterized by, in comparison with stratified ones, a rather low toughness behavior in combination with a very high plastic deformation resistance. The comparably low toughness level and high deformation resistance shown by this type of cemented carbides are largely due to the enrichment of cubic phase and the corresponding binder phase depletion in a zone below the binder phase enriched zone.

Cemented carbides containing stratified binder phase gradients are normally characterized by extremely good toughness behavior in combination with somewhat inferior plastic deformation resistance. The toughness behavior is a result of both the binder phase enrichment and the stratified structure of the binder phase enrichment. The reduced plastic deformation resistance is to the dominating part caused by local sliding in the thick binder phase stratified layers closest to the surface due to the very high shear stresses in the cutting zone.

OBJECTS AND SUMMARY OF THE INVENTION

It is an object of this invention to avoid or alleviate the problems of the prior art.

It is further an object of this invention to provide a coated cemented carbide insert with a binder phase enriched surface zone and a process for the making of the same.

It is also an object of this invention to provide a coated cemented carbide insert having both good toughness behavior and a high plastic deformation resistance.

In one aspect of the invention there is provided a cemented carbide body containing WC and cubic phases in a binder phase with a binder phase enriched surface zone, wherein the binder phase enriched surface zone has an outer portion essentially free of cubic phase and an inner portion containing cubic phase and stratified binder phase layers.

In another aspect of the invention there is provided a method of manufacturing binder phase enriched cemented carbide comprising sintering a presintered or compacted cemented carbide body containing nitrogen and carbon in an inert atmosphere or in vacuum, 15 to 180 min at 1380°–1520° C., followed by slow cooling, 20°–100° C./h, through the solidification region, 1300°–1220° C.

In yet another aspect of the invention there is provided a method of manufacturing a binder phase enriched cemented carbide comprising sintering a slightly subeutectic cemented carbide body in a carburizing atmosphere containing a mixture of $CH_4/H_2$ and/or $CO_2/CO$ for 30–180 min at 1380° C. to 1520° C. followed by slow cooling in the same atmosphere or an inert atmosphere or vacuum.

BRIEF DESCRIPTION OF THE DRAWINGS

In FIGS. 1 and 2, A+B refers to the binder phase enriched surface zone, C is an inner zone and S refers to stratified layers of binder phase.

DETAILED DESCRIPTION OF THE PREFERRED EMBODIMENTS OF THE INVENTION

Surprisingly, it has now been found that by combining binder phase enrichment by dissolution of cubic phase with the requirements that result in formation of stratified layers, a unique structure is obtained. The structure according to the present invention is characterized by, in comparison with the ones previously known, deeper situated stratified layers and lower and less sharp maximum binder phase enrichment. The possibility of combining dissolution of the cubic phase with formation of stratified layers offers new ways to optimize the properties of tungsten carbide based cemented carbides for cutting tools.

Figure 1:
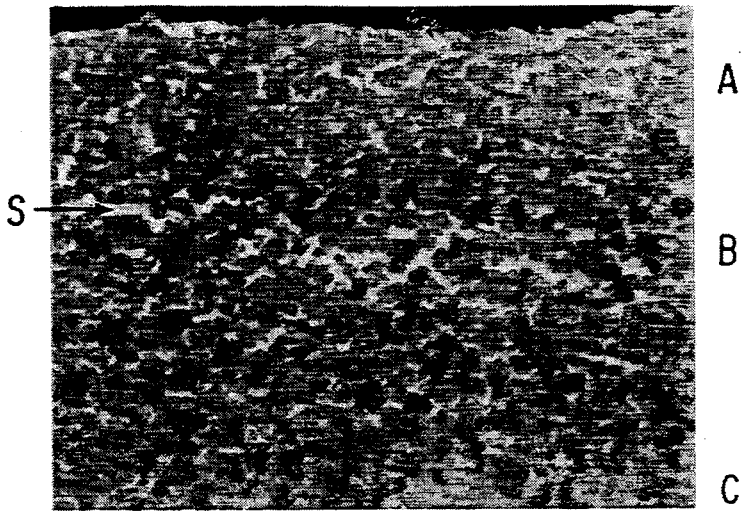
FIG. 1 shows in 1200X the structure of a binder phase enriched surface zone according to the present invention.
Figure 2:
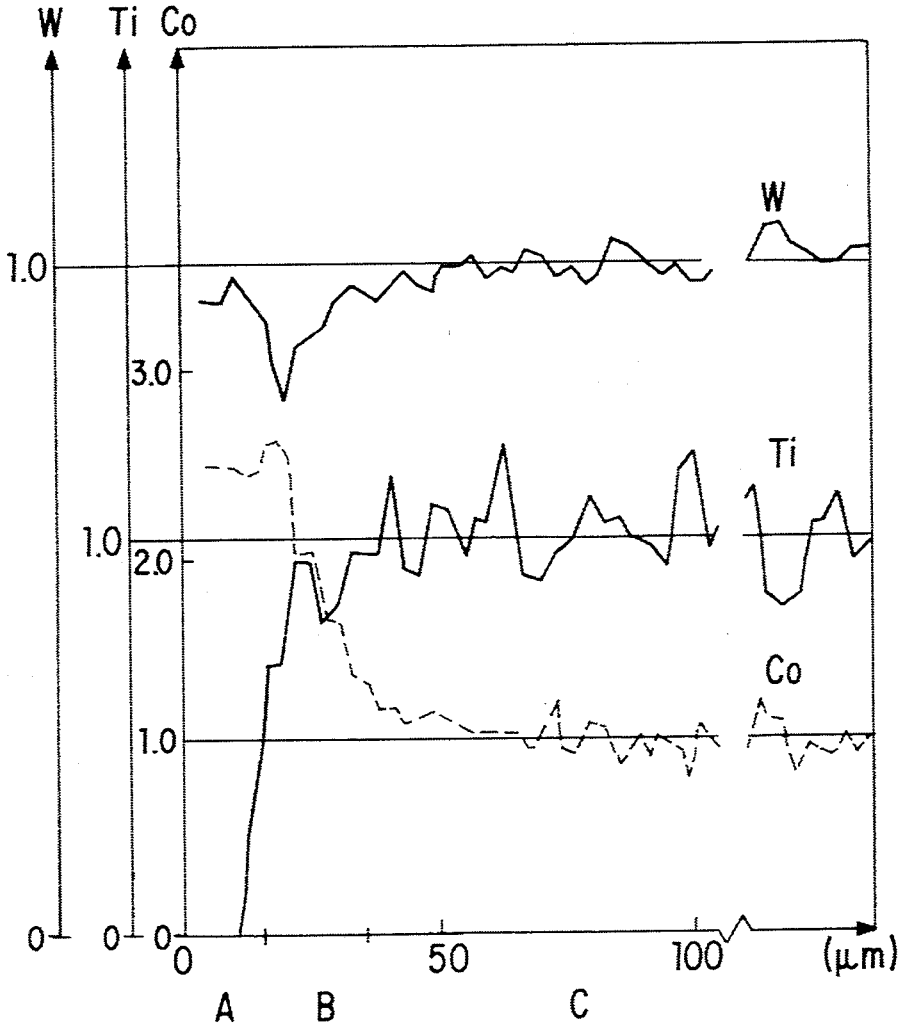
FIG. 2 shows the distribution of Ti, Co, and. W in the binder phase enriched surface zone according to the present invention.

According to the present invention, there is now provided a cemented carbide with <75 μm thick, preferably 25–50 μm thick, binder phase enriched surface zone, A+B (FIGS. 1 and 2). The outer part A of this binder phase enriched surface zone, at least 10 μm thick, preferably <25 μm thick, is essentially free of cubic phase. The inner part B of the surface zone, at least 10 μm thick, preferably <30 μm thick, contains cubic phase as well as stratified binder phase layers S. The stratified binder phase layers are in this inner part B thick and well-developed whereas they are thin and with very small spread in the outer part A of the surface zone. The binder phase content of the binder phase enriched surface zone is above the nominal content of binder phase in the body as a whole and has a maximum in the inner part B of 1.5–4 times, preferably 2–3 times, the nominal binder phase content. In addition, the tungsten content of the inner part B of the surface zone is less than the nominal tungsten content of the body as a whole and is <0.95, preferably 0.75–0.9, of the nominal tungsten content. The binder phase enriched surface zone as well as an about 100–300 μm thick zone below it C with essentially nominal content of WC, cubic phase and binder phase contains no graphite. However, in the interior of the cemented carbide according to the present invention, there is a C-porosity of C04–C08. On top of the cemented carbide surface there is a thin, 1–2 μm, cobalt and/or graphite layer.

The present invention is applicable to cemented carbides with varying amounts of binder phase and cubic phase. The binder phase preferably contains cobalt and dissolved carbide forming elements such as tungsten, titanium, tantalum and niobium. However, there is no reason to believe that an intentional or unintentional addition of nickel or iron should influence the result appreciably, nor will small additions of metals that can form intermetallic phases with the binder phase or any other form of dispersion appreciably influence the result.

The amount of binder phase forming elements can vary between 2% and 10% by weight, preferably between 4% and 8% by weight. The amount of cubic phase forming elements can be varied rather freely. The process works on cemented carbides with varying amount of titanium, tantalum, niobium, vanadium, tungsten and/or molybdenum. The optimum combination of toughness and deformation resistance is achieved with an amount of cubic carbide corresponding to 4–15% by weight of the cubic carbide forming elements titanium, tantalum and niobium, etc., preferably 7–10% by weight. The amount of added nitrogen, either added through the powder or through the sintering process, determines the rate of dissolution of the cubic phase during sintering. The optimum amount of nitrogen depends on the amount of cubic phase and can vary between 0.1% and 3% by weight per % by weight of group IVB and VB elements.

The amount of carbon in the binder phase required to achieve the desired stratified structure according to the present invention coincides with the eutectic composition, i.e., graphite saturation. The optimum amount of carbon is, thus, a function of all other elements and cannot easily be numerically stated but can be determined by the skilled artisan in accordance with known techniques for any given situation. The carbon content can be controlled either by a very accurate blending and sintering procedure or by a carburization treatment in connection with the sintering.

Production of cemented carbides according to the present invention is most favorably done by sintering a presintered or compacted cemented carbide body containing nitrogen and, for formation of stratified layers an optimum amount of carbon as discussed above, in an inert atmosphere or in a vacuum, for 15 to 180 min. at 1380°–1520° C., followed by slow cooling, 20°–100° C./h, preferably 40°–75° C./h, through the solidification region, 1300°–1220° C., preferably 1290°–1250° C. An alternative route includes sintering a slightly subeutectic body in a carburizing atmosphere containing a mixture of $CH_4/H_2$ and/or $CO_2/CO$, 30–180 min. at 1380° to 1520° C. followed by slow cooling according to above in the same atmosphere, preferably in an inert atmosphere or vacuum.

Cemented carbide inserts according to the present invention are preferably coated with known thin wear resistant coatings with CVD- or PVD-technique. Preferably there is deposited an innermost coating of carbide, nitride, carbonitride, oxycarbide, oxynitride or oxycarbonitride preferably of titanium followed by, e.g., an oxide, preferably aluminum oxide, top coating. Prior to the deposition, the cobalt and/or graphite layer on top of the cemented carbide surface is removed, e.g., by electrolytic etching or blasting.

The invention is additionally illustrated in connection with the following Examples which are to be considered as illustrative of the present invention. It should be understood, however, that the invention is not limited to the specific details of the Examples.

EXAMPLE 1

From a powder mixture consisting of 2.2 weight % TiC, 0.4 weight % TiCN, 3.6 weight % TaC, 2.4 weight % NbC, 6.5 weight % Co and rest WC with 0.25 weight % overstoichiometric carbon content, turning inserts CNMG 120408 were pressed. The inserts were sintered in $H_2$ up to 450° C. for dewaxing, further in a vacuum to 1350° C. and after that in a protective atmosphere of Ar for 1 h at 1450° C. This part is according to standard practice. The cooling was performed with a well-controlled temperature decrease of 60° C./h within the temperature interval 1290° to 1240° C. in the same protective atmosphere as during the sintering. After that, the cooling continued as normal furnace cooling with a maintained protective atmosphere.

The structure in the binder phase enriched surface zone of the insert was a 15 μm thick moderately binder phase enriched outer part A essentially free of cubic phase in which the stratified binder phase structure was weakly developed. Below this outer part, there was a 20 μm thick zone B containing cubic phase with a strong binder phase enrichment as a stratified binder phase structure. The maximum cobalt content in this part was about 17 weight %. Further below this part B, there was a zone C about 150–200 μm thick with essentially nominal content of cubic phase and binder phase but without graphite. In the inner of the insert, graphite was present up to C08. On the surface there was a thin film of cobalt and graphite. This film was removed by an electrochemical method in connection with the edge rounding treatment. The inserts were coated according to known CVD-technique with an about 10 μm coating of TiCN and $Al_2O_3$.

EXAMPLE 2

From a similar powder mixture as in Example 1, but with about 0.20 weight % overstoichiometric carbon content, turning inserts CNMG 120408 were pressed. The inserts were sintered in $H_2$ tip to 450° C. for dewaxing, further in vacuum to 1350° C. and after that in a carburizing, 1 bar, $CH_4/H_2$, atmosphere, for 1 h at 1450° C. Cooling was performed in a protective, inert atmosphere with a well-controlled temperature decrease of 60° C./h within the temperature interval 1290° to 1240° C. After that, the cooling continued as normal furnace cooling with maintained protective atmosphere.

The structure of the inserts was essentially identical to that of the inserts of the preceding Example. The inserts were etched, edge rounded and coated according to Example 1.

EXAMPLE 3—COMPARATIVE EXAMPLE

From a similar powder mixture as in Example 1, but with TiC instead of TiCN, inserts were pressed of the same type and sintered according to Example 1. The structure in the surface of the inserts was characterized by compared to that of Example 1 that zone A was almost missing (<5 μm), i.e., zone B with cubic phase and strong binder phase enrichment extended to the surface and a sharp cobalt maximum of about 25 weight %. Zone C had the same structure as in Example 1. The inserts were etched, edge rounded and coated according to Example 1.

EXAMPLE 4

From a powder mixture consisting of 2.7 weight % TiCN, 3.6 weight % TaC, 2.4 weight % NbC, 6.5 weight % Co and rest WC with 0.30 weight % overstoichiometric carbon content, turning inserts CNMG 120408 were pressed. The inserts were sintered in $H_2$ up to 450° C. for dewaxing, further in vacuum to 1350° C. and after that in a protective atmosphere of Ar for 1 h at 1450° C. This part is according to standard practice.

During the cooling, a well-controlled temperature decrease was performed with 70° C./h within the temperature range 1295° to 1230° C. in the same protective atmosphere as during sintering. After that, the cooling continued as normal furnace cooling with maintained protective atmosphere.

The structure in the surface zone of the inserts consisted of a 25 μm thick moderately binder phase enriched outer part essentially free of cubic phase and essentially free of stratified binder phase structure A. Below this outer part, there was a 15 μm thick zone containing cubic phase and with a moderate binder phase enrichment as a stratified binder phase structure B. The maximum cobalt content in this part was about 10 weight %. Zone C and the interior of the inserts were identical to Example 1. The inserts were etched, edge rounded and coated according to Example 1.

Example 5—Comparative Example

From a similar powder mixture as in Example 4, inserts were pressed of the same type and sintered according to Example 4 but without the controlled cooling step.

The structure in the surface of the insert consisted of outermost a 20–25 μm thick moderately binder phase enriched zone essentially free from cubic phase. No tendency to stratified binder phase was present. Below this superficial zone there was an about 75–100 μm thick zone depleted of binder phase and enriched in cubic phase. The minimum cobalt content in this zone was about 5 weight %. The inner of the inserts exhibited C-porosity C08. The inserts were etched, edge rounded and coated according to Example 4.

EXAMPLE 6

With the CNMG 120408 inserts of Examples 1, 2, 3, 4 and 5, a test consisting of an intermittent turning operation in an unalloyed steel with the hardness HB110 was performed with the following cutting data:

| | |
|---|---|
| Speed: | 80 m/min |
| Feed: | 0.30 mm/rev |
| Cutting depth: | 2 mm |

30 edges of each variant were run until fracture or max 10 min. The average tool like is shown in the table below.

| | Average Tool Life, min |
|---|---|
| Example 1 (invention) | 10 (no fracture) |
| Example 2 (invention) | 10 (no fracture) |
| Example 3 (known technique) | 10 (no fracture) |
| Example 4 (invention) | 4.5 |
| Example 5 (known technique) | 0.5 |

In order to differentiate, if possible, between Examples 1, 2 and 3, the same test was repeated with cutting fluid. The following results were obtained:

| | Average Tool Life, min |
|---|---|
| Example 1 (invention) | 10 (still no fracture) |
| Example 2 (invention) | 10 (still no fracture) |
| Example 3 (known technique) | 10 (still no fracture) |
| Example 4 (invention) | 1.5 |
| Example 5 (known technique) | 0.1 |

EXAMPLE 7

The inserts from Examples 1, 2, 3, 4 and 5 were tested in a continuous turning operation in a tough-hardened steel with the hardness HB280. The following cutting dam were used.

| | |
|---|---|
| Speed: | 250 m/min |
| Feed: | 0.25 mm/rev |
| Cutting depth: | 2 mm |

The operation led to a plastic deformation of the cutting edge which could be observed as a flank wear on the clearance face of the insert. The time to a flank wear of 0.4 mm was measured for five edges each with the following results:

| | Average Tool Life, min |
|---|---|
| Example 1 (invention) | 8.3 |
| Example 2 (invention) | 8.0 |
| Example 3 (known technique) | 3.5 |
| Example 4 (invention) | 18.5 |
| Example 5 (known technique) | 20.3 |

From Examples 6 and 7, it is apparent that inserts according to the invention, Example 4, exhibit a considerably better toughness behavior than according to known technique without having significantly impaired their deformation resistance. In addition, inserts according to the present invention in Examples 1 and 2, have a clearly better deformation resistance without losing toughness behavior compared to known technique. It is evident that a large span in cutting properties and thereby application area can be obtained.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A cemented carbide body containing WC and cubic phases in a binder phase with a binder phase enriched surface zone, wherein the binder phase enriched surface zone has an outer portion essentially free of cubic phase and an essentially constant binder content and an inner portion containing cubic phase and stratified binder phase layers in which the tungsten content is less than the nominal tungsten content of the body as a whole and is no more than 95% of the nominal tungsten content of the cemented carbide at any point within the said inner portion.

2. The cemented carbide body of claim 1 wherein said surface zone is $<75$ μm, said outer portion is $>10$ μm, and said inner portion is $>10$ μm thick.

3. The cemented carbide body of claim 2 wherein said surface zone is 20–50 μm, said outer portion is $<25$ μm, and said inner portion is $<30$ μm thick.

4. The cemented carbide body of claim 1 wherein in said inner portion, the binder phase content is above the nominal binder phase content of the body as a whole and has a maximum of 1.5–4 times the nominal binder phase content.

5. The cemented carbide body of claim 4 wherein in said inner portion, the binder phase content has a maximum of 2–3 times the nominal binder phase content.

* * * * *